US007004386B2

(12) United States Patent
Chien

(10) Patent No.: US 7,004,386 B2
(45) Date of Patent: Feb. 28, 2006

(54) CASH DRAWER

(76) Inventor: Te-Hsin Chien, No. 331, Sec. 1, Pao-An Street, Shulin City, Taipei Hsien (TW)

( * ) Notice: Subject to any disclaimer, the term of this patent is extended or adjusted under 35 U.S.C. 154(b) by 0 days.

(21) Appl. No.: 10/900,673

(22) Filed: Jul. 27, 2004

(65) Prior Publication Data

US 2006/0022031 A1 Feb. 2, 2006

(51) Int. Cl.
*G07G 1/00* (2006.01)

(52) U.S. Cl. ..... 235/379; 235/7 R; 235/10; 235/22; 235/27

(58) Field of Classification Search ..... 235/7 R, 235/10, 22, 379, 27; 232/10; 206/565, 562.81, 206/557; 312/294, 350, 330.1, 319.8
See application file for complete search history.

(56) References Cited

U.S. PATENT DOCUMENTS 1,389,981 A * 9/1921 Randall ..... 235/22
1,746,715 A * 2/1930 Price ..... 235/22
2,070,064 A * 2/1937 Pasinski ..... 312/334.21
2,517,175 A * 8/1950 Bremer ..... 109/47
3,015,435 A * 1/1962 Hecker ..... 235/22
3,628,724 A * 12/1971 Showers, Jr. ..... 235/22
3,761,694 A * 9/1973 Englund et al. ..... 235/61 PB
3,855,432 A * 12/1974 Kelly et al. ..... 200/61.61
4,101,745 A * 7/1978 Smith ..... 200/61.61
4,155,610 A * 5/1979 Englund ..... 312/222
4,182,539 A * 1/1980 Busch ..... 312/333
4,424,426 A * 1/1984 Ishii ..... 200/61.61
4,603,239 A * 7/1986 Ishii ..... 200/61.61
4,642,449 A * 2/1987 Baitz et al. ..... 235/22
RE32,456 E * 7/1987 Ishii ..... 200/61.61
4,720,611 A * 1/1988 Ishii ..... 200/61.61
4,811,579 A * 3/1989 Lyons et al. ..... 70/85
4,873,850 A * 10/1989 Lyons et al. ..... 70/85
4,895,008 A * 1/1990 Blake ..... 70/86
5,371,344 A * 12/1994 Buie et al. ..... 235/1 R
5,372,417 A * 12/1994 Buie et al. ..... 312/245
5,723,850 A * 3/1998 Lambert ..... 235/22
6,116,504 A * 9/2000 Ariga ..... 235/22
6,814,281 B1 * 11/2004 Anderson et al. ..... 235/22
2001/0050307 A1 * 12/2001 Fukuyama ..... 235/7 R
2002/0145341 A1 * 10/2002 Corbett et al. ..... 310/12
2003/0116618 A1 * 6/2003 Moriya et al. ..... 235/22

FOREIGN PATENT DOCUMENTS

EP 59352 A1 * 9/1982

* cited by examiner

*Primary Examiner*—Karl D. Frech
*Assistant Examiner*—Daniel Walsh
(74) *Attorney, Agent, or Firm*—Pro-Techtor Int'l Services

(57) ABSTRACT

A cash drawer comprises a casing, a drawer with a lock head and a connecting rod, a shift plate, a locking device, an opening device, a guiding device and a transmitting device, wherein the drawer is closed by being pushed rearward and opened by turning the lock head, so that the locking device becomes disengaged from a locked state, or by being pushed further rearward, so that, driven by the guiding device, the locking device is lifted and thus disengaged from the locked state, without any need for electric power.

5 Claims, 12 Drawing Sheets

CASH DRAWER

BACKGROUND OF THE INVENTION

1. Field of the Invention

The present invention relates to a cash drawer, particularly to a cash drawer which is closed by a simple pushing movement and opened by turning a lock head or by an inward pushing movement, with an elastic force driving a drawer outward without any need for electric power, so that dependence on electric power supply of conventional cash drawers is avoided.

2. Description of Related Art

As shown in FIGS. 11 and 12, a conventional cash drawer comprises a casing 10; a drawer 20; a shift plate 30; a bottom plate 38; a locking device 40; a spring 47; and an opening device 50. The casing 10 has left and right sides carrying rails 11 and rolls 12. The drawer 20 has left and right sides outside of which rails 21 and rolls 22 are mounted which glide on the casing 10. The drawer 20 has a front side on which a lock head 24 is mounted performing opening and closing movements. A connecting rod 26 leads from the lock head 24 rearward and passes through a rear wall of the drawer 20. The shift plate 30 is an elongated plate mounted on the rear wall of the drawer 20 and having a right end and a left end. The right end of the shift plate 30 accommodates a rear end of the connecting rod 26 to glide therein. A middle section of the shift plate 30 has positioning grooves 34 guiding the shift plate 30 to glide over positioning pins 36 and preventing the shift plate 30 from being displaced. The left end of the shift plate 30 is perpendicularly bent, forming an pushing end 37, and is movable to the left and right. The bottom plate 38 is fastened to a lower side of the casing 10 close to a rear side thereof and at a middle position carries a holding knob 39. The locking device 40, as shown in FIG. 4, has an axis 41 mounted on the drawer 20 in front of the rear wall thereof, a catch plate 43, which in a middle part thereof is set on the axis 41, a hook 44, leaning against the pushing end 37 of the shift plate 30, and a catch opening 45 that in a locked state of the drawer 20 engages with the holding knob 39. A spring 47 has an end connected with the catch plate 43 on the axis 41 and another end connected with the rear wall of the drawer 20. The opening device 50 comprises a holding case 52, mounted on the bottom plate 38, an opening spring 54, fastened to the holding case 52 at a front side thereof, and a magnet 60, mounted on the bottom plate 38. The magnet 60 has a push bar 61 to which a push rod 63 is fastened. When electric current passes through the magnet 60, the push bar 61 thereof is longitudinally moved, taking the push rod 63 away from the catch plate 43, so that an opening movement of the catch plate 43 is performed. Closing the drawer 20 causes the catch plate 43 to engage with the holding knob 39 and to be held there in the locked state. For opening the drawer 20, the lock head 24 is manually or by electronic control turned into an open position, causing the connecting rod 26 to shift the shift plate 30 and to operate the magnet 60, so that the push rod 63 and the shift plate 30 move away from the catch plate 43, so that the catch opening 45 thereof becomes disengaged from the holding knob 39 on the bottom plate 38 and the opening spring 54 pushes the drawer 20 outward.

Conventional cash drawers like those just described have a simple structure and are widely used, but have the following disadvantages. (1) Operation is dependent on supply of electricity, and (2) power consumption for repeated opening and closing of the drawer is high.

SUMMARY OF THE INVENTION

It is the object of the present invention to provide a cash drawer which allows to be opened without electric power supply by turning a lock head or further rearward pushing, with a guiding device via a transmitting device unlocking a locking device.

The present invention can be more fully understood by reference to the following description and accompanying drawings.

DETAILED DESCRIPTION OF THE PREFERRED EMBODIMENT

As shown in FIGS. 1–4, the cash drawer of the present invention comprises: a casing 10; a drawer 20; a shift plate 30; a locking device 40; an opening device 50; a guiding device 70; and a transmitting device 90. The casing 10, having rails 11, rolls 12 and a bottom plate 13, and the drawer 20, having rails 21, rolls 22, a lock head 24 and a connecting rod 26, the locking device 40 and the opening device 50 are designed like conventional art. A description thereof regarding structural parts, assembly and working of the present invention is brought in the following.

The rails 11 and rolls 12 are placed on left and right sides of the casing 10.

The drawer 20 has left and right surfaces outside of which the rails 21 and rolls 22 are mounted, allowing the drawer 20 to glide forward and rearward in the casing 10 in opening and closing movements, respectively. The lock head 24 is mounted on a front plate of the drawer 20 and is operated to move between an open state and a close state. The connecting rod 26 has a front end connected with the lock head 24 and a rear end passing through a rear wall of the drawer 20.

The shift plate 30 is a horizontally oriented elongated plate mounted behind the rear wall of the drawer 20 and having a right end with a guiding hole 32 through which the rear end of the connecting rod 26 passes and a left end that is perpendicularly bent rearward to form an pushing end 37. A middle section of the shift plate 30 has positioning grooves 34 guiding the shift plate 30 to glide over positioning pins 36 and preventing the shift plate 30 from being displaced. The shift plate 30 is movable to the left and to the right.

The bottom plate 13 is mounted on a lower side of the casing 10, close to a rear side thereof and carries a holding knob 39.

The locking device 40 has an axis 41, placed before the rear wall of the drawer 20, and a catch plate 43, at a middle section thereof set on the axis 41 and being able to perform a turning movement around the axis 41. The catch plate 43 has a rearward extending end passing through the rear wall of the drawer 20 with a catch opening 45. The catch opening 45 has a front wall and a rear wall and in a locked state engages with the holding knob 39 on the bottom plate 13. A spring 47 has two ends that are respectively connected with the catch plate 43 behind the axis and with the rear wall of the drawer 20.

The opening device 50 has a holding case 52, mounted on the bottom plate 13, and an opening spring 54, fastened to the holding case 52 at a front side thereof.

The guiding device 70 is glidingly set on the bottom plate 13 of the casing 10 and comprises: a guiding plate 71 having a front elongated hole 72 and a rear elongated hole 73; a front positioning element 74 placed inside the front elongated hole 72; a rear positioning element 75 placed inside the rear elongated hole 73; a spring 76, placed between the front positioning element 74 and a fastening element 77 and pushing the guiding plate 71 forward; a front ridge 78, extending upward from the guiding plate 71 at a left edge thereof and having a rear end with an inclined part 82; a blocking plate 79, placed on the guiding plate 71 behind the front ridge 78; and a rear ridge 81, placed on the guiding plate 71 behind the blocking plate 79 and having a top extending forward in an extension 83 with an inclined part 85 at a far end thereof. A gap 84 is left between the blocking plate 79 and the rear ridge 81. A vertical plate 86 is attached to the guiding plate 71 at a front end thereof, preventing damaging of the guiding device 70 if the drawer 20 is exposed to excessive force.

As shown in FIGS. 1, 8 and 9, the transmitting device 90 comprises: a transmitting plate 91; an L-shaped positioning plate 98; an axis 92; a turning plate 93; a torsional spring 94; a helical spring 95; and a lifting plate 96. The transmitting plate 91 has a rear end that carries the positioning plate 98, which rotates around the axis 92 on the bottom plate 13, a middle section supported by the holding case 52 of the opening device 50, and a front end carrying a perpendicularly upward bent vertical end 91*a*. The turning plate 93 is set on the axis 92, having an inner end close to the positioning plate 98 and a free outer end. The torsional spring 94 is placed above the turning plate 93, having a lower end 941 attached to the turning plate 93 and an upper end 942 attached to the positioning plate 98, pushing the turning plate 93 to be oriented perpendicular to the transmitting plate 91. The helical spring 95 is inserted between the vertical end 91*a* of the transmitting plate 91 and the bottom plate 13. The lifting plate 96 has an inner end mounted on the transmitting plate 91 and a free outer end into which an opening 97 with inclined walls is cut. A spring 99 presses down on the lifting plate 96. In the embodiment described here, the transmitting plate 91 ia placed below the catch plate 43.

Referring to FIGS. 1–5, when the drawer 20 is open, with the guiding plate 71 of the guiding device 70 and the opening spring 54 of the opening device 50 not being exposed to external forces, the guiding plate 71 is pressed forward by the spring 76, and the opening spring 54 extends forward. In this state, the outer end of the turning plate 93 lies behind the rear ridge 81.

As shown in FIG. 6, when the drawer 20 has been manually pushed into the casing 10, external forces act on the opening spring 54 and the guiding plate 71, causing the guiding plate 71 to move backward, guided by the front and rear elongated holes 72, 73. At the same time, the inclined part 82 of the front ridge 78 glides over the outer end of the lifting plate 96 of the transmitting device 90, which subsequently rises gradually. Furthermore, the inclined part 85 of the rear ridge 81 glides over the outer end of the turning plate 93, which subsequently rises gradually and is stopped by the blocking plate 79 as soon as the gap 84 has been reached. Since the extension 83 and the blocking plate 79 have a mutual distance that is smaller than the width of the turning plate 93, the outer end of the turning plate 93 enters the gap 84. At the same time, the catch opening 45 of the locking device 40 becomes engaged with the holding knob 39, with the holding knob 39 leaning against the front wall of the catch opening 45.

Referring to FIG. 7, when the drawer 20 is released, the opening spring 54 causes the drawer to open, with the guiding plate 71 being pushed forward by the spring 76. Then the outer end of the turning plate 93 is held in the gap 84 between the blocking plate 79 and the rear ridge 81, and the holding knob 39 leans against the rear wall of the catch opening 45.

Referring to FIGS. 8 and 9, when the drawer 20 is further pushed rearward, the blocking plate 79 on the guiding plate 71 moves rearward, taking along the outer end of the turning plate 93, so that the transmitting plate 91 turns on the axis 92, with the opening 97 on the lifting plate 96 straddling the front ridge 78. This causes the transmitting plate 91 to rise, so that the catch opening 45 in the catch plate 43 disengages from the holding knob 39.

Referring to FIG. 10, when external applied forces gradually decrease, the guiding device 70 moves forward, and the lifting plate 96 gradually shifts rearward and to the right until the opening 97 thereof engages with the front ridge 78 and glides along the front ridge 78. Thereby the transmitting plate 91 pushes for a short time against the catch plate 43, causing the catch plate 43 to remain engaged with the holding knob 39. Only when the opening 97 no longer is in contact with the front ridge 78, the catch opening 45 of the catch plate disengages from the holding knob 39. At this time, the spring 94 pushes the turning plate 93 towards the rear of the gap 84, so that the outer end of the turning plate 93 disengages from the rear ridge 81.

The present invention allows, using the catch plate 43 of the locking device 40, to close the drawer 20 in a well-defined manner. Turning the lock head 24 to the open state thereof moves the shift plate 30 to have the catch plate 43 disengage from the holding knob 39. Further rearward pressing of the drawer 20 causes the guiding device 70 to take along the transmitting device 90, with the transmitting plate 91 pushing the catch plate 43 to disengage from the holding knob 39.

While the invention has been described with reference to a preferred embodiment thereof, it is to be understood that modifications or variations may be easily made without departing from the spirit of this invention which is defined by the appended claims.

Figure 1:
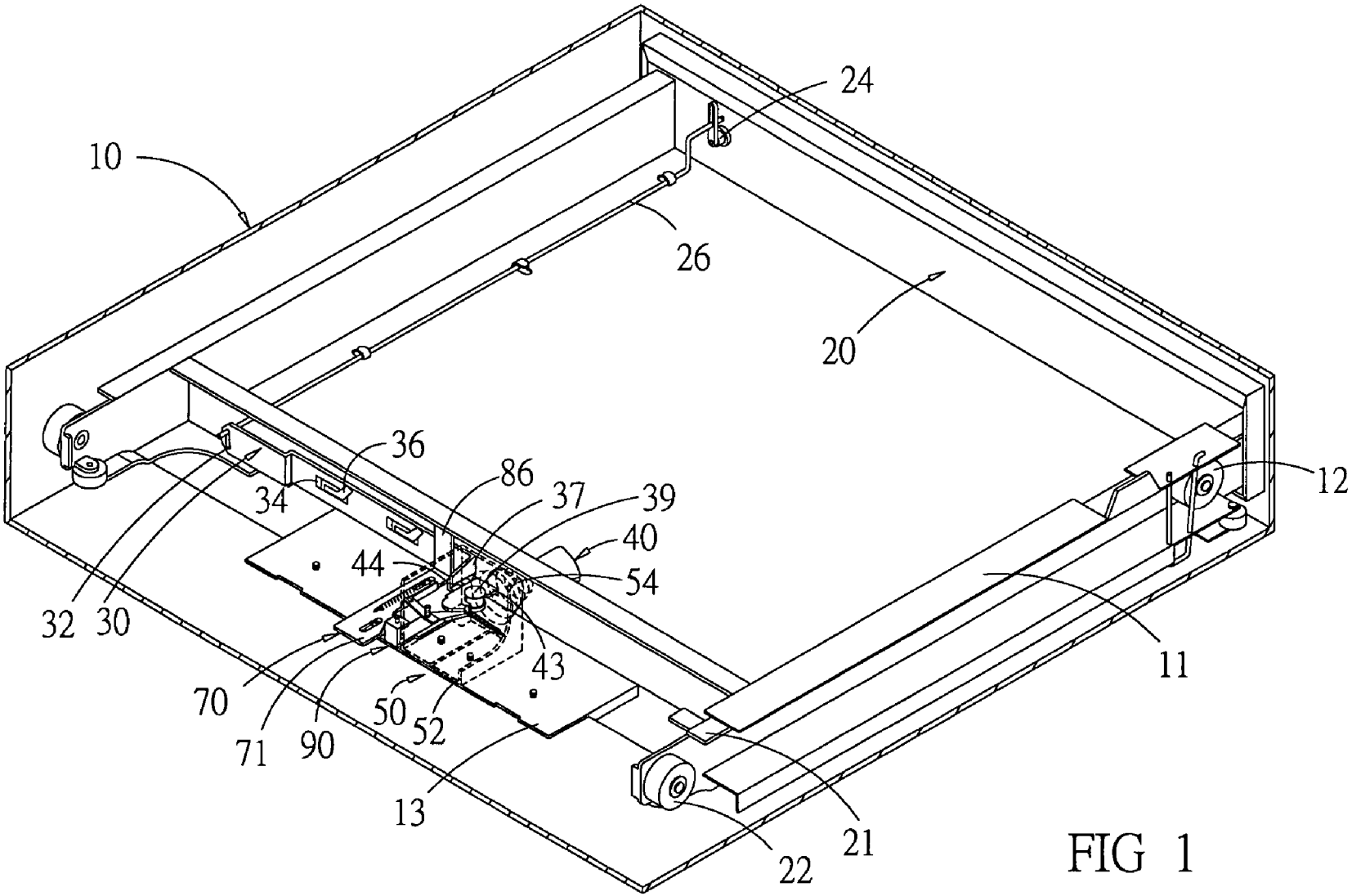
FIG. 1 is a perspective view of the cash drawer of the present invention, with the left side and the top side of the casing removed.
Figure 2:
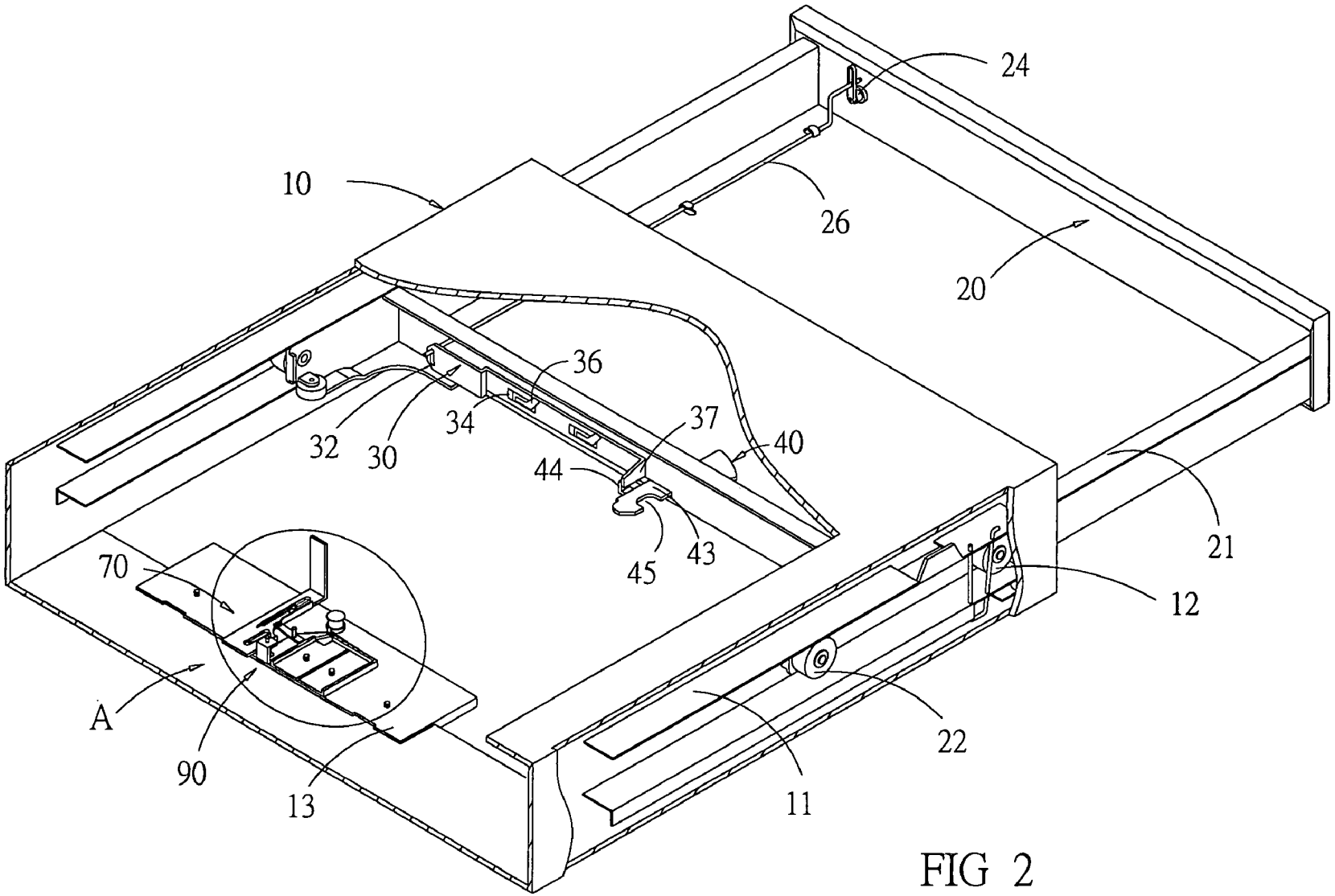
FIG. 2 is a perspective view of the cash drawer of the present invention, with the drawer opened and the opening device removed.
Figure 3:
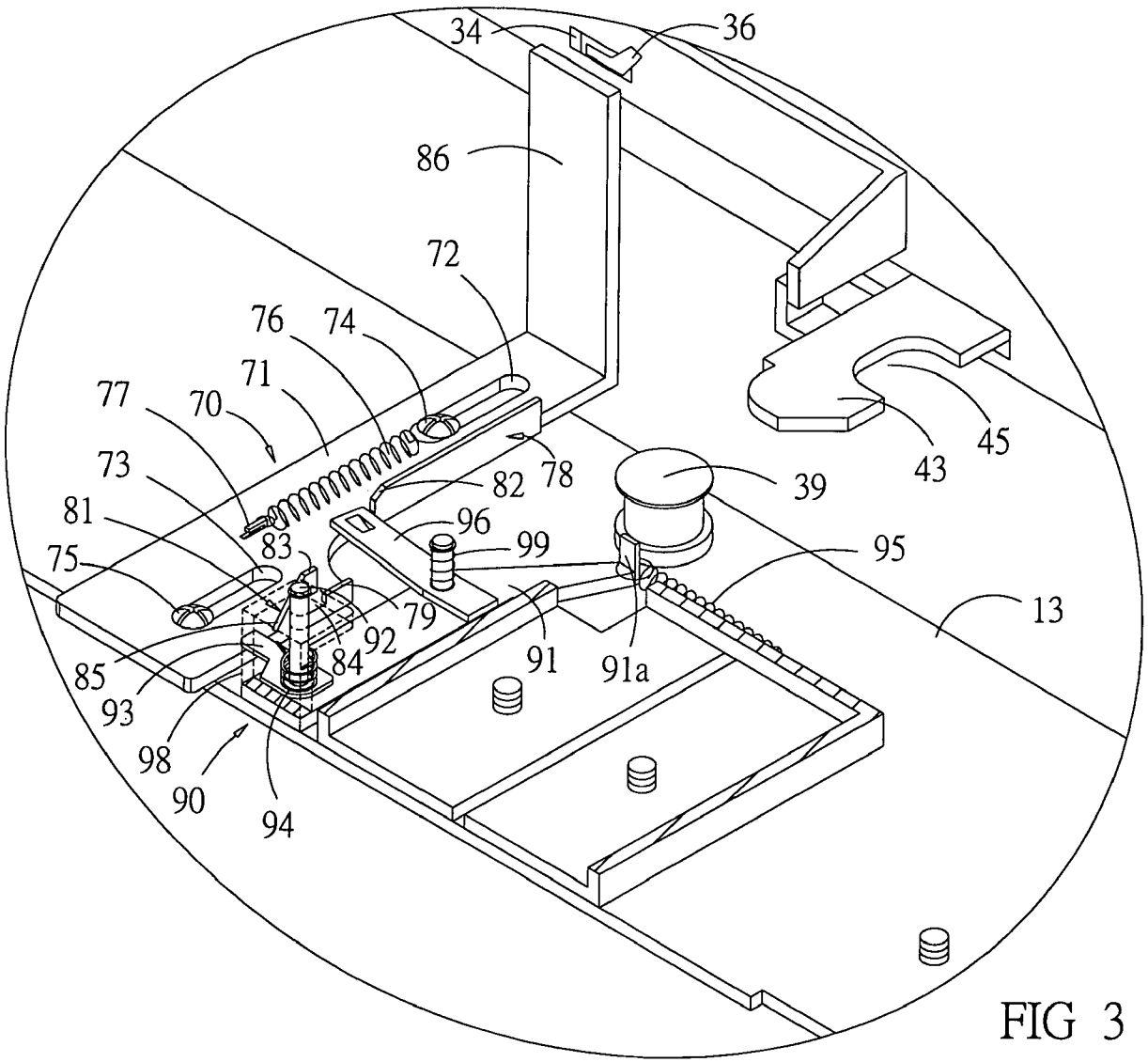
FIG. 3 is a perspective view of the locking device, the guiding device and the transmitting device of the present invention.
Figure 4:
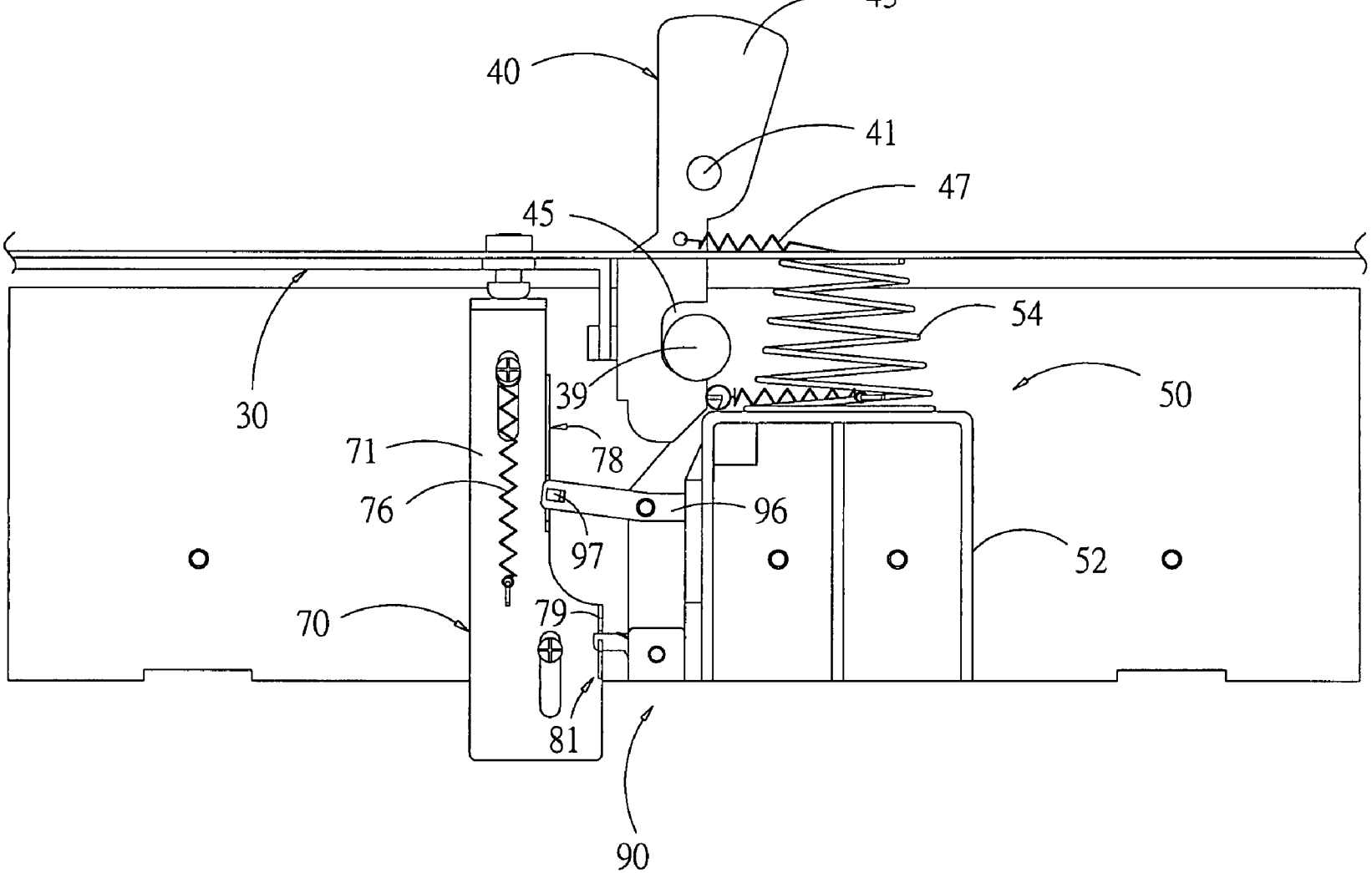
FIG. 4 is a top view of the locking device, the opening device, the guiding device and the transmitting device of the present invention.
Figure 5:
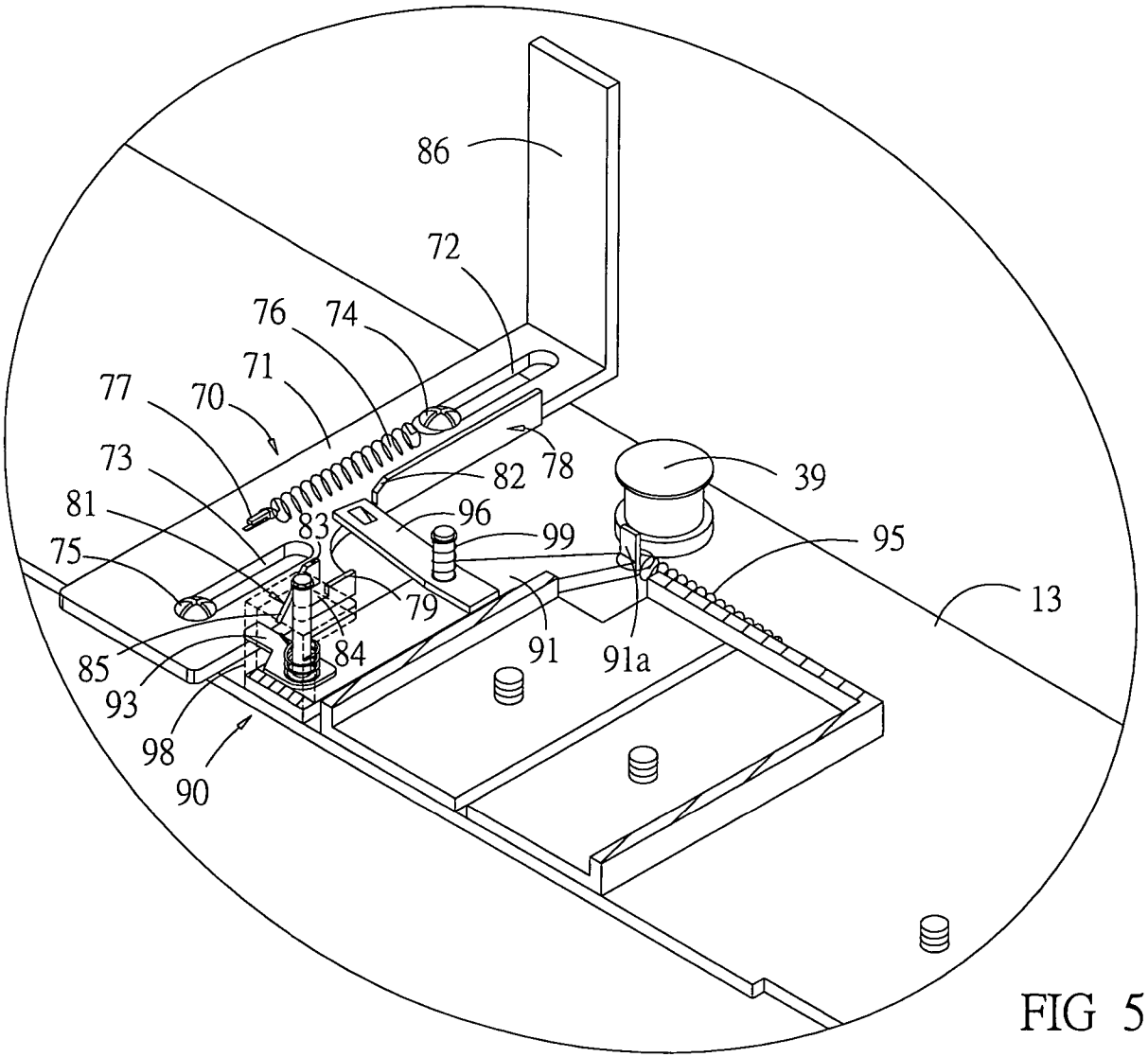
FIG. 5 is an enlarged perspective view of part A of FIG. 2, with the drawer not yet being released.
Figure 6:
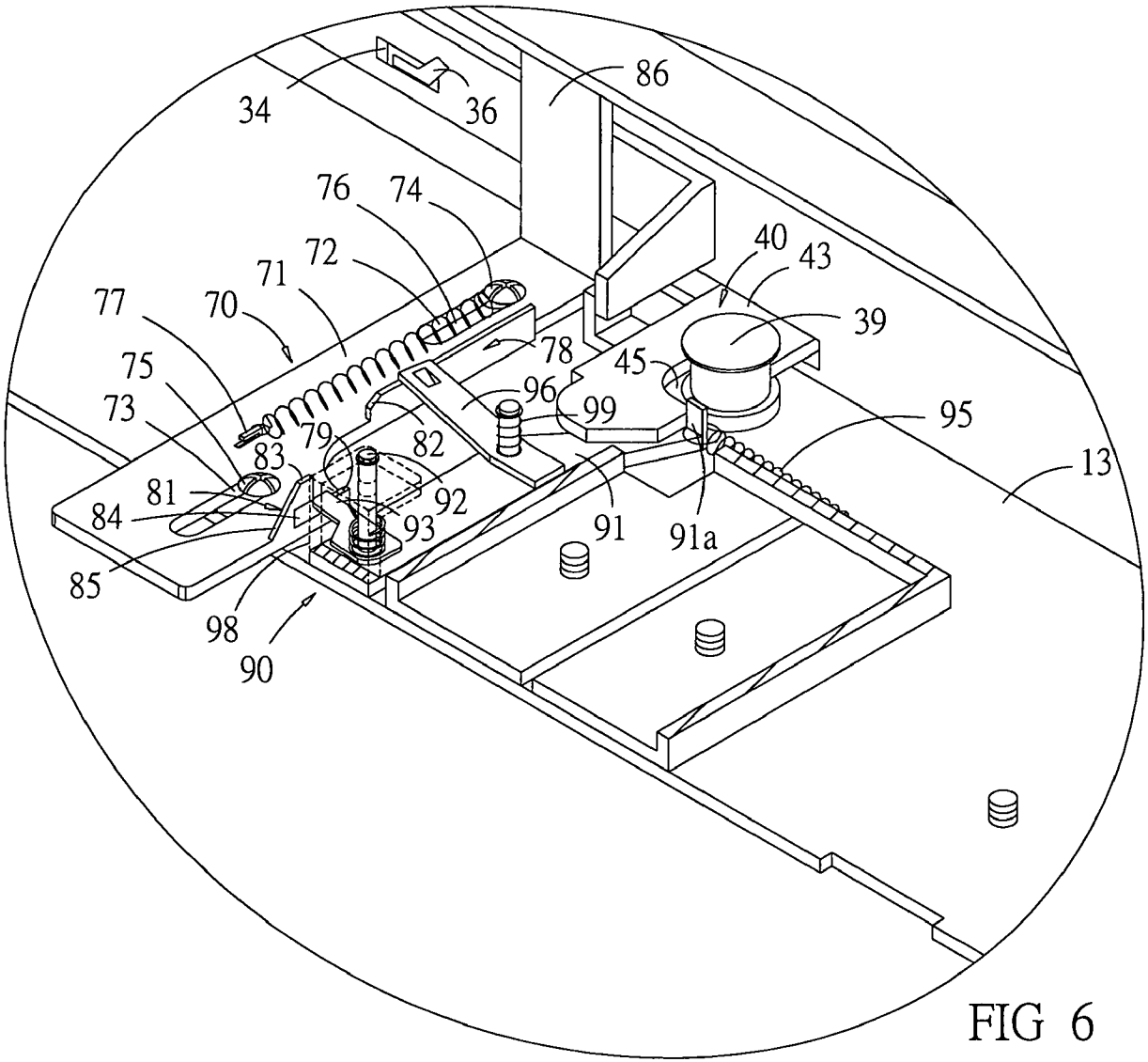
FIG. 6 is an enlarged perspective view of part A of FIG. 2, with the drawer being pressed rearward a first time.
Figure 7:
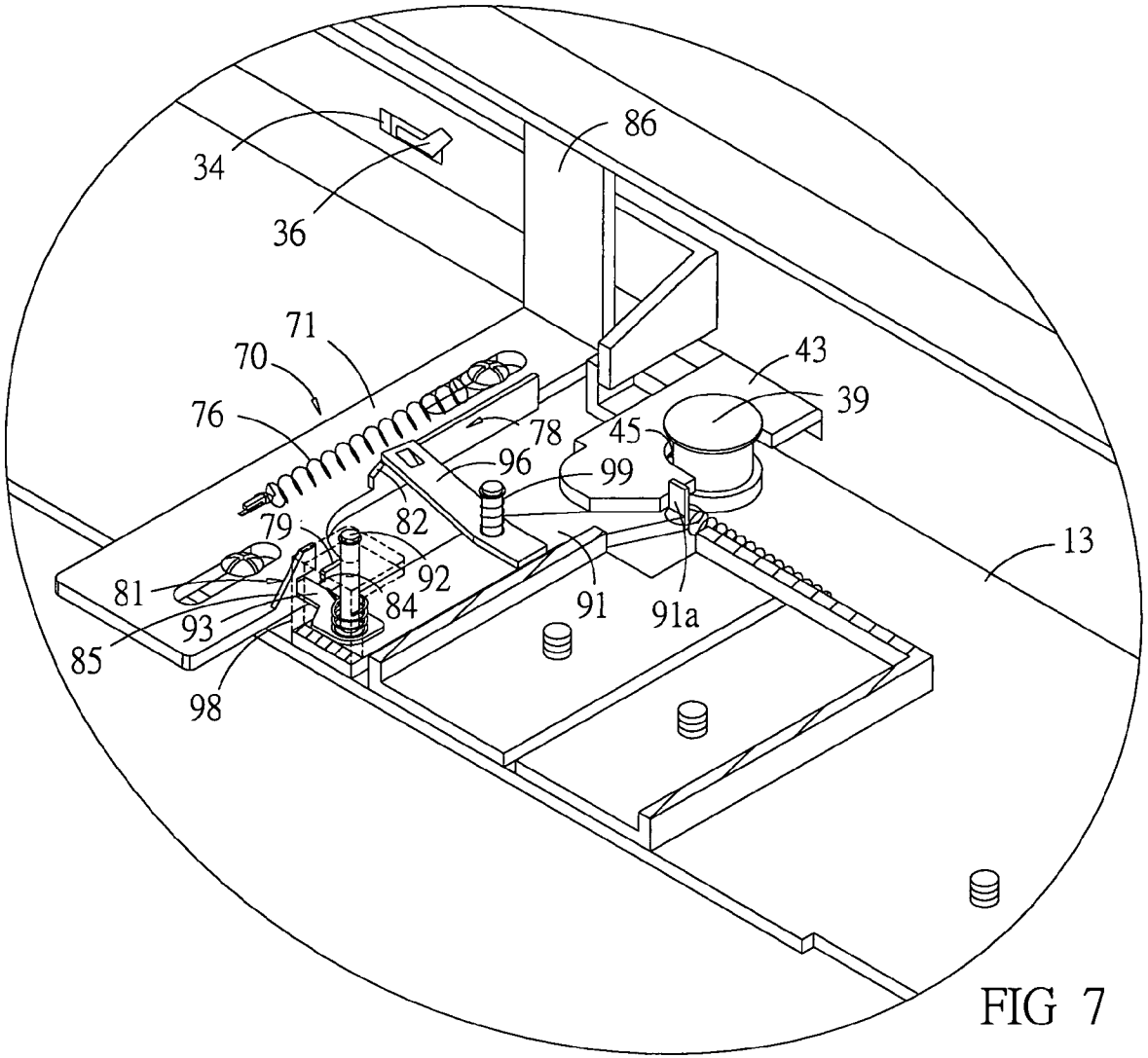
FIG. 7 is an enlarged perspective view of part A of FIG. 2, with the drawer being released after having been pressed rearward a first time.
Figure 8:
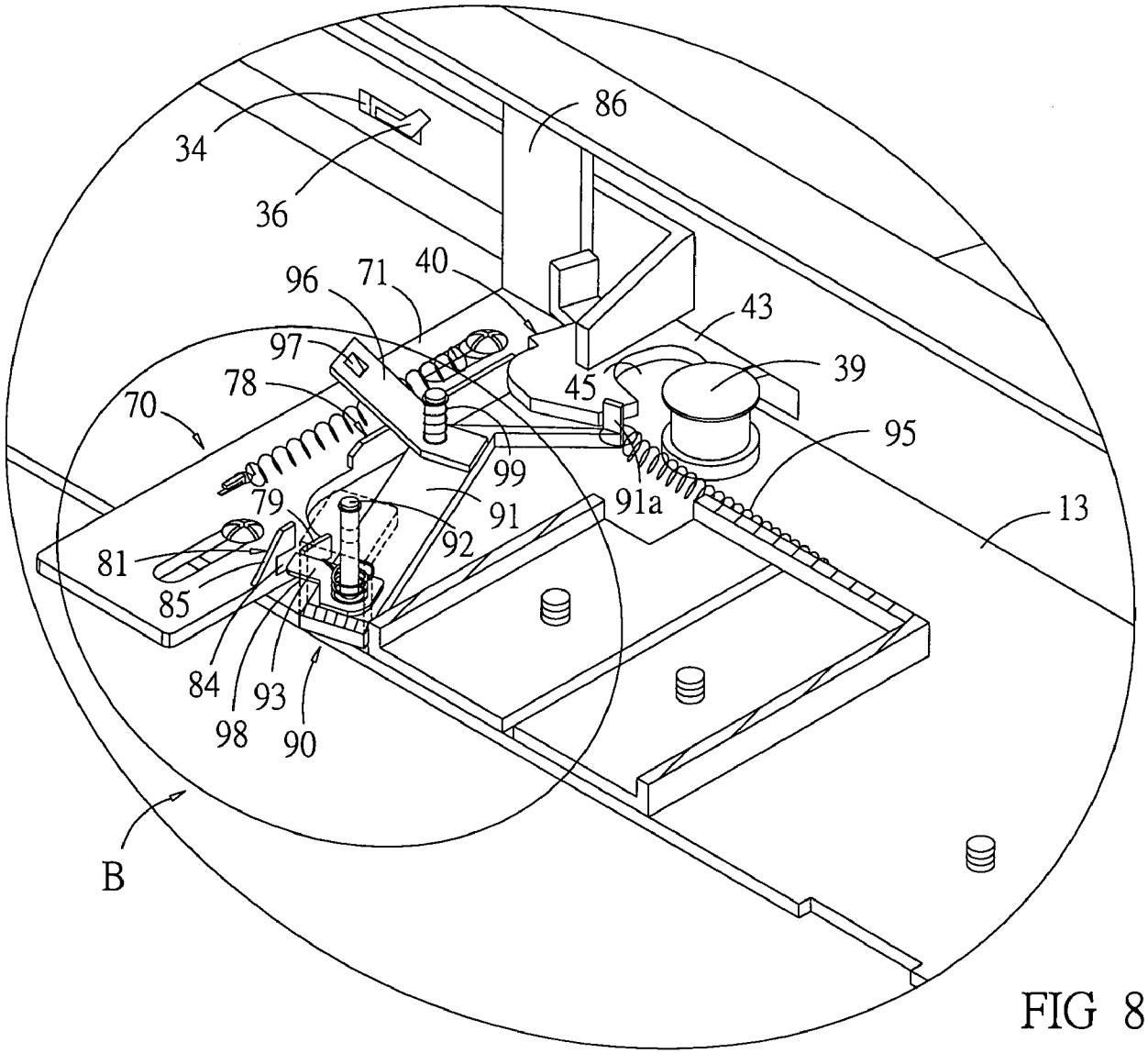
FIG. 8 is an enlarged perspective view of part A of FIG. 2, with the drawer being pressed rearward a second time.
Figure 9:
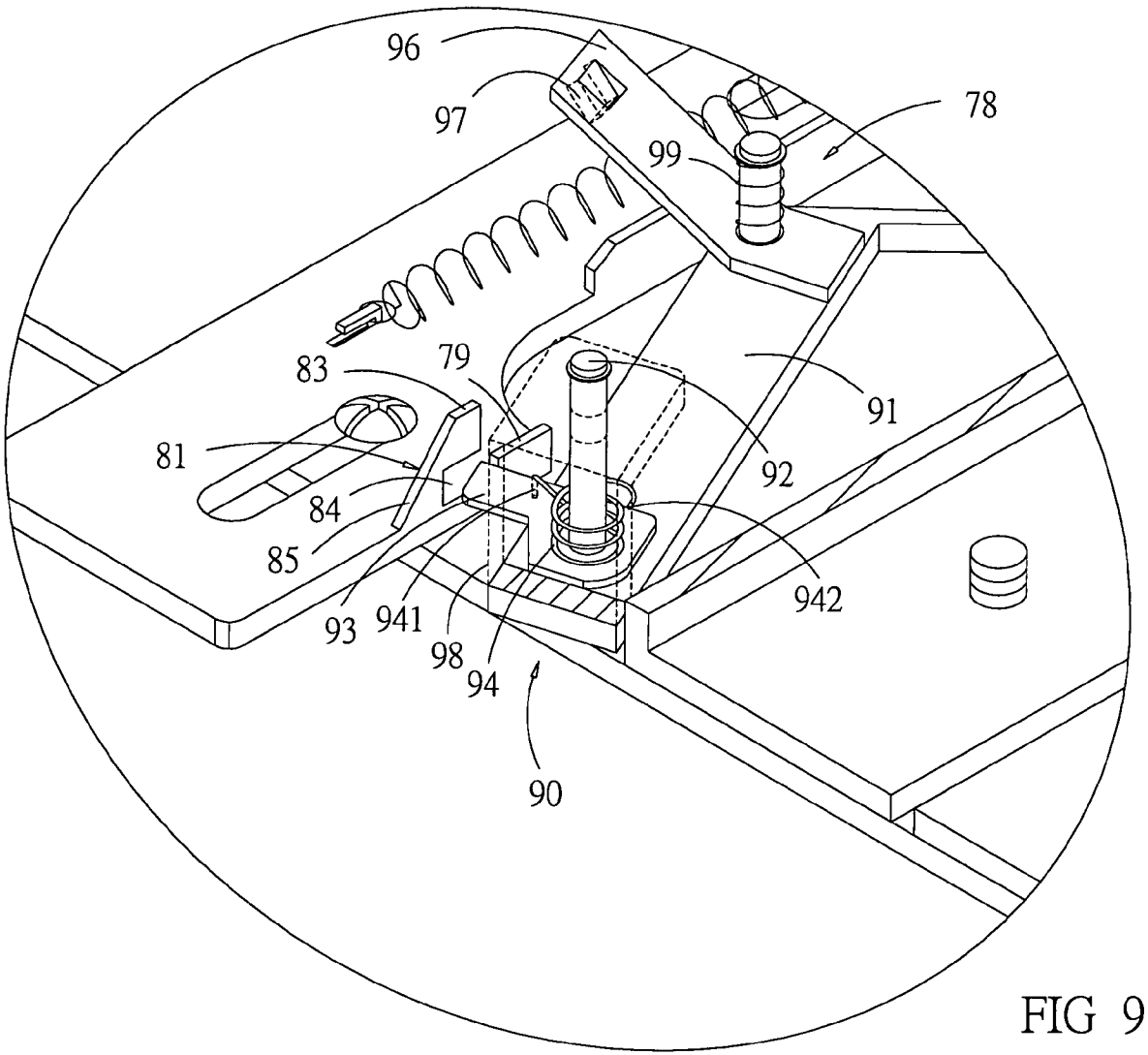
FIG. 9 is an enlarged perspective view of part B of FIG. 8.
Figure 10:
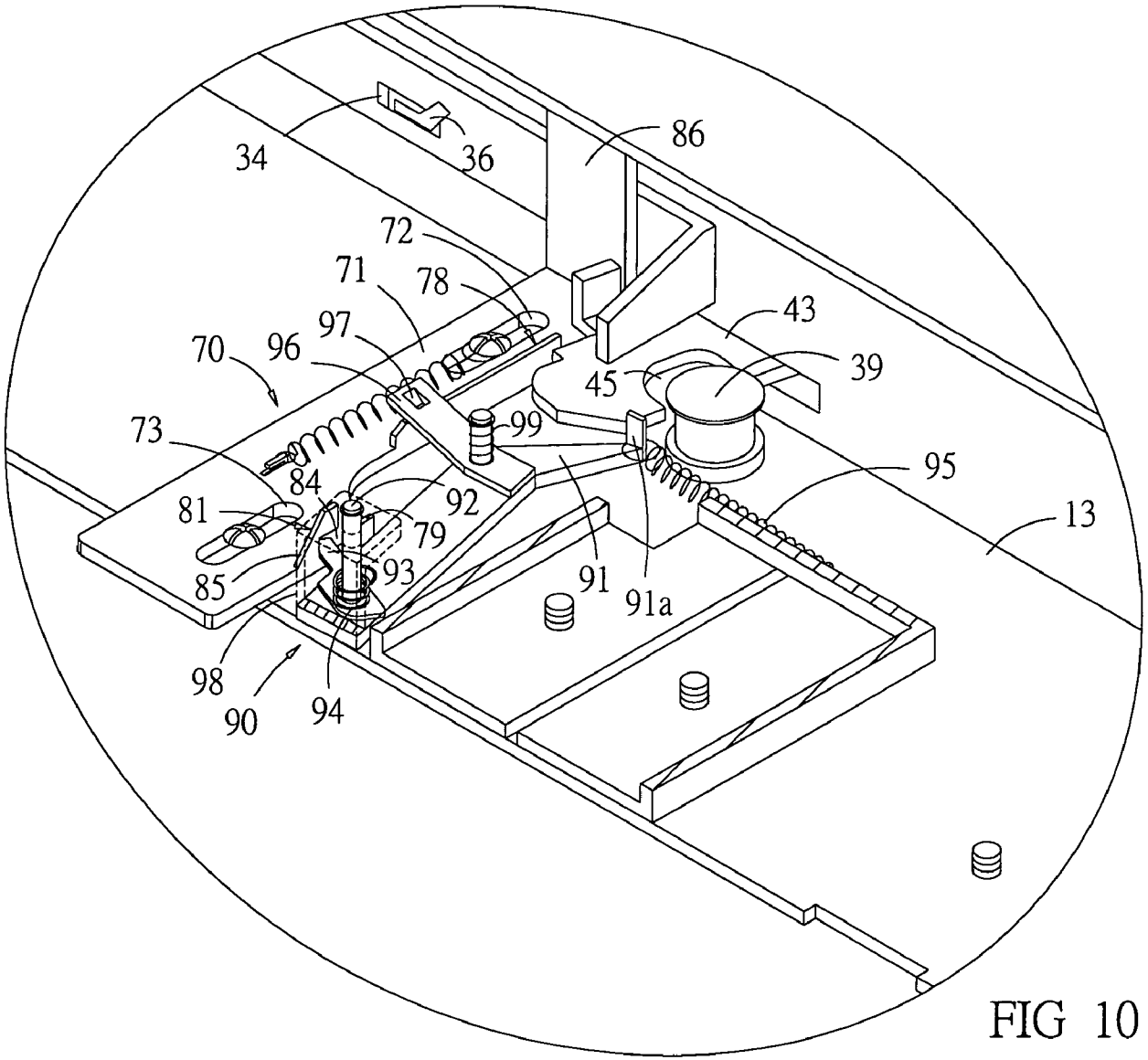
FIG. 10 is an enlarged perspective view of part A of FIG. 2, with the drawer being released after having been pressed rearward a second time.
Figure 11:
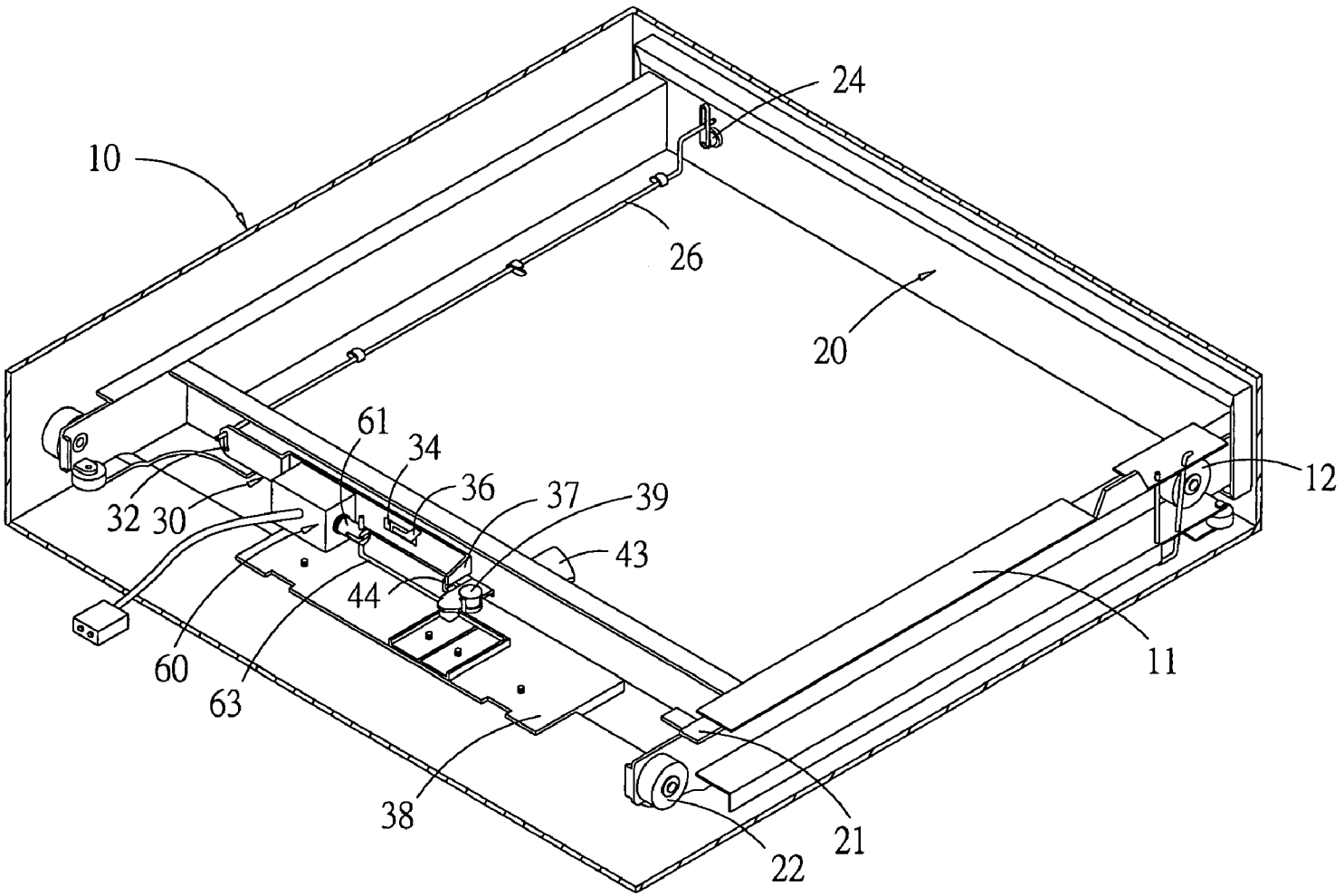
FIG 11 (PRIOR ART)
FIG. 11 is a perspective view of a conventional cash drawer, with the left side and the top side of the casing removed.
Figure 12:
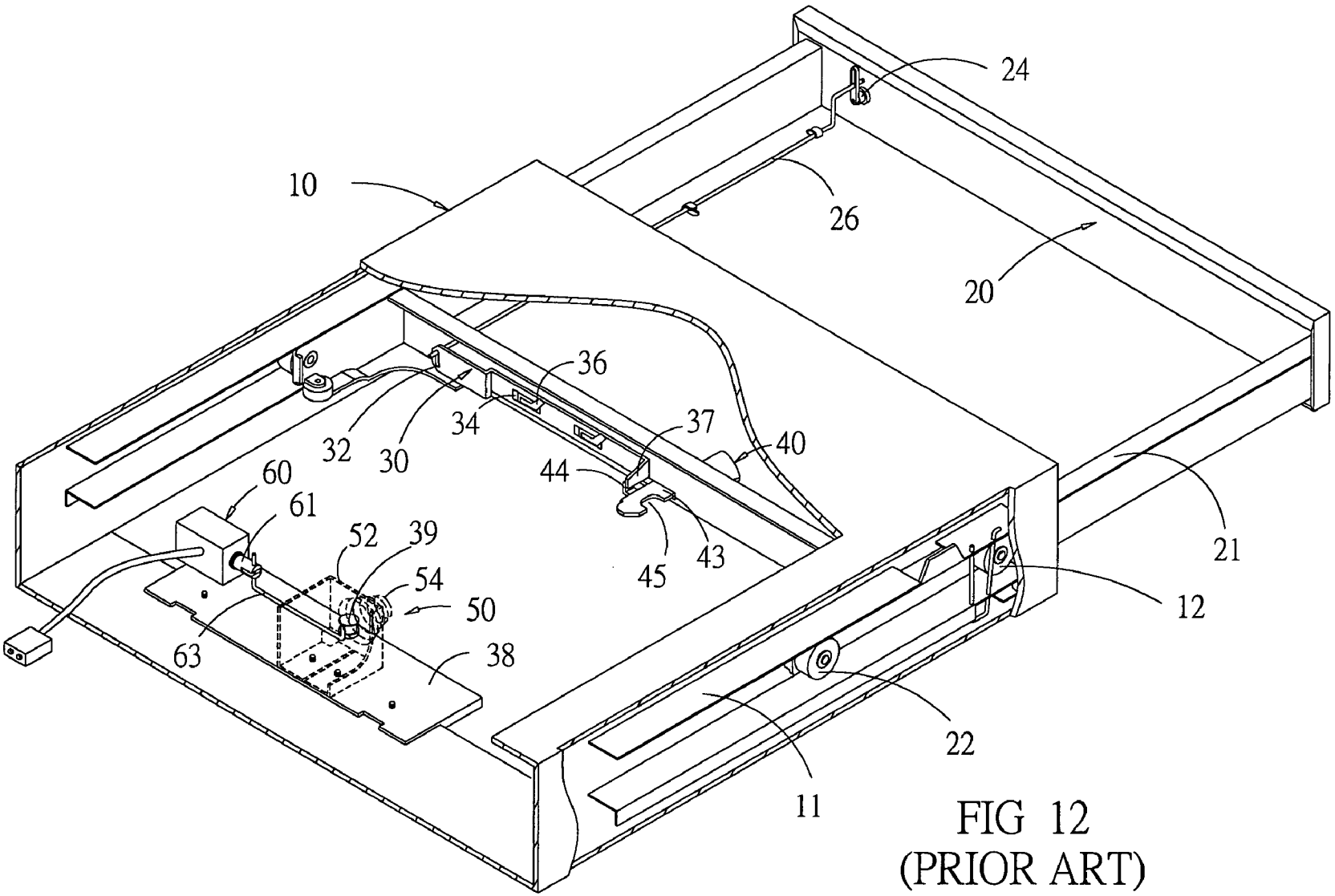
FIG 12 (PRIOR ART)
FIG. 12 is a perspective view of a conventional cash drawer, with the drawer opened, the spring of the opening device removed and the holding case of the opening device partly removed.

What is claimed is:

1. A cash drawer, comprising:

a casing, having left and right sides with rails and rolls and a bottom plate on which a holding knob is fastened;

a drawer, having left and right sides outside of which rails and rolls are mounted to allow for a closing movement into said casing, defining a rearward direction, and an opposite opening movement into a forward direction, having a front plate on which a lock head is mounted and a connecting rod, reaching from said lock head rearward and passing through a rear wall, with a shift plate being mounted behind said rear wall, performing a horizontal shifting movement driven by said connecting rod and guided by positioning grooves gliding on positioning pins;

a locking device, further comprising a first axis, placed before said rear wall of said drawer, a catch plate, having a middle section that is set on said first axis and a rear end passing through said rear wall with a catch opening which in a locked state engages with said holding knob, and a spring, inserted between said catch plate behind said first axis and said rear wall;

an opening device, having a holding case fastened on said bottom plate and an opening spring on said holding case on a front side thereof;

a guiding device, mounted on said bottom plate and further comprising a guiding plate, having a left edge, a front ridge, extending upward from said left edge of said guiding plate, a blocking plate, placed on said guiding plate behind said front ridge, and a rear ridge, placed on said guiding plate behind said blocking plate, with a gap left between said blocking plate and said rear ridge; and a transmitting device, further comprising a transmitting plate, having a rear end on which an L-shaped positioning plate is mounted and which is rotatably connected with said bottom plate by a second axis and having a front end which is bent perpendicularly upward, forming a vertical end, a turning plate, having an inner end rotatably set on said second axis and a free outer end, a torsional spring, having a lower end fastened to said turning plate and an upper end fastened to said positioning plate, and a helical spring, inserted between said front end of said transmitting plate and said bottom plate at a position to the left of said transmitting plate;

wherein said drawer, when held by said locking device being in said locked state, is opened by turning said lock head, so that said catch plate disengages from said locked state, or by being further pushed rearward, so that said guiding device takes along said transmitting device, so that catch plate disengages from said locked state, without any need for electric power.

2. The cash drawer according to claim 1, wherein said guiding plate has a front end which is bent perpendicularly upward, a front elongated hole and a rear elongated hole, with front and rear positioning elements resectively passing through said front and rear elongated holes guiding forward and rearward movements of said guiding plate, and wherein a spring is inserted between said front positioning element and a fastening element.

3. The cash drawer according to claim 1, wherein said front ridge has an inclined part.

4. The cash drawer according to claim 1, wherein said rear ridge has an inclined part and a forward reaching extension.

5. The cash drawer according to claim 3, wherein a lifting plate at an inner end thereof is mounted on a middle section of said transmitting plate, having an outer end that leans on said inclined part of said front ridge.

* * * * *